US005511839A

United States Patent [19]

Fuss et al.

[11] Patent Number: 5,511,839

[45] Date of Patent: Apr. 30, 1996

[54] DOOR OPENER WITH A LOCKABLE, PIVOTABLE LATCH

[75] Inventors: Fritz H. Fuss, Albstadt, Germany; John S. Rutherford, Virginia Beach, Va.; Gerhard Gonser, Albstadt, Germany

[73] Assignee: Fritz Fuss GmbH & Co., Germany

[21] Appl. No.: 249,210

[22] Filed: May 26, 1994

[30] Foreign Application Priority Data

May 26, 1993 [DE] Germany ..... 43 17 564.3

[51] Int. Cl.[6] ..... E05B 15/02

[52] U.S. Cl. ..... 292/341.18; 292/341.12; 292/DIG. 56; 292/DIG. 60

[58] Field of Search ..... 292/340, 341, 292/341.11–341.13, 341.16, 341.18, DIG. 56, DIG. 57, DIG. 55, DIG. 60

[56] References Cited

U.S. PATENT DOCUMENTS

| | | | |
|---|---|---|---|
| 417,845 | 12/1889 | Stone | 292/341.13 |
| 831,016 | 9/1906 | Parker | 292/341.16 |
| 1,194,636 | 8/1916 | Joy | 292/341.11 |
| 1,595,046 | 8/1926 | Martin | 292/341.12 |
| 1,900,077 | 3/1933 | Riffle | 292/34.11 |
| 2,153,110 | 4/1939 | Waterbury | 292/341.12 |
| 2,187,530 | 1/1940 | Butler | 292/341.12 |
| 4,756,564 | 7/1988 | Ikeda | 292/DIG. 56 |
| 4,783,103 | 11/1988 | Schlegel | 292/341.12 |
| 4,856,829 | 8/1989 | Nakamura | 292/DIG. 56 |
| 4,867,496 | 9/1989 | Thomas | 292/341.16 |
| 5,020,838 | 6/1991 | Fukumoto | 292/DIG. 56 |
| 5,141,270 | 8/1992 | Shibata | 292/DIG. 56 |

FOREIGN PATENT DOCUMENTS

| | | | |
|---|---|---|---|
| 2560918 | 8/1985 | France . | |
| 469643 | 7/1937 | United Kingdom | 292/341.12 |

OTHER PUBLICATIONS

DuPont Co. Product Literature for ZYTEL (Nylon Resin).

*Primary Examiner*—Steven N. Meyers
*Assistant Examiner*—Gary Estremsky
*Attorney, Agent, or Firm*—Sixbey, Friedman, Leedom & Ferguson; David S. Safran

[57] ABSTRACT

A door opener with a pivotable latch for fitting in a door frame, where a door engages in its closed position with a bolt on a locking surface of the latch for fixing the door position in the door frame and which is characterized in that the latch has a latch base and at least one adapting element, the locking surface is formed on the adapting element, the adapting element is connectable to the latch base and the adapting element has a predeterminable thickness for the adjustment of the door in the closed position.

10 Claims, 4 Drawing Sheets

DOOR OPENER WITH A LOCKABLE, PIVOTABLE LATCH

FIELD OF THE INVENTION

The invention relates to a door opener with a lockable, pivotable latch for fitting in a door frame, in which in its closed position a door engages with at least one bolt on a locking surface of the latch for fixing the position of the door in the door frame, the door being openable by a pivoting movement of the unlocked latch.

BACKGROUND OF THE INVENTION

Door openers of this type have long been used in door systems, in which a locked door is to be unlocked from a point remote from said door. For example, by means of an electric signal the latch in the door frame is unlocked, so that the opening of the door is made possible. On swinging up the door the unlocked latch is at least temporarily pivoted out of its locked position. For unlocking and pivoting the latch such a door opener has various mechanical and electrical components which, prior to the installation of the door opener in the door frame, are pre-assembled with the latch.

As the position of the door in its closed position is on the one hand defined by the door frame and on the other by the latch, the position of the locking surface of the latch must be accurately matched with the bearing surface of the door on the door frame. For this purpose the position of the locking surface of the latch is determined by measurement and calculation. A risk then exists that the position of the latch is not sufficiently precisely or is incorrectly determined. After fitting the door opener in the door frame the clearance of the closed door in said frame is consequently too large or too small, so that it is necessary to dismantle the door opener and carry out a readjustment. For readjustment purposes use is e.g. made of spacing plates parallel to the bearing surface and which can be inserted or removed with the latch between a locking plate and a door opener unit. If, following the installation of the door opener there is once again an incorrect positioning in the door frame, this readjustment process must be repeated until the desired clearance of the door in its closed position is adequately precisely obtained.

Therefore the fitting of the door opener can be very time-consuming and therefore cost-intensive. In the case of fitting and dismantling several times it is also possible for the locking plate and screw heads for fixing the latter to become scratched or otherwise damaged. There is also a risk of the loosening or breaking off of the connecting cables for an electrical operation of the door opener.

SUMMARY OF THE INVENTION

The object of the invention is to provide a door opener with a lockable, pivotable latch for a door frame, in which it is possible to particularly easily set or adjust the clearance of a closed door in said door frame.

According to the invention this object is achieved in that the latch has a latch body and at least one adapting element, that the locking surface is constructed on the adapting element, that the adapting element is connectable to the latch base and that the adapting element has a predeterminable thickness for the adjustment of the door in the closed position.

As the locking surface of the latch is still accessible from the outside after installing the door opener in the door frame, the adapting element can be fixed to the latch base following the installation of the door opener. According to the invention, a readjustment of the locking surface can be carried out in time and cost-saving manner with the door opener installed in the door frame. A scratching or damaging of the locking plate, the fastening screws and the electric lines and connections as a result of multiple fitting and dismantling of the door opener are avoided.

The adapting element also makes it possible to form different shapes of the locking surface on the latch base. As a result the door opener can be adapted to different bolt types. It is therefore possible to manufacture the door opener in large numbers in a basic variant and these are adapted solely by means of the adapting elements with different locking face constructions to the particular bolt type of the door lock.

According to an advantageous further development of the door opener according to the invention, the latch base with the matching element is housed in a door opener insert, the latter is detachably connected to a locking plate for fixing the door opener in the door frame and there is at least one spacing plate having a predeterminable thickness which is surface-parallel to the locking surface between the door opener insert and the locking plate for presetting the position of the locking surface in the door frame. This preadjustment ensures that no excessive clearance width has to be compensated by a correspondingly thick adapting element.

In a particularly advantageous embodiment of the door opener according to the invention the connection between the latch base and the adapting element is detachable. As a result of a detachable connection between the adapting element and the latch base the possibility exists of replacing an already fitted adapting element by another one having a different thickness or locking surface shape. Thus, an adapting element chosen too thick for increasing the door clearance can be replaced by a thinner adapting element. Subsequent maintenance work or regulating the door clearance is significantly simplified. For example, the door clearance can increase as a result of wear to door seals along the door frame. In the prior art in the case of such wear the door seal and/or fitting position of the door opener had to be changed. In the case of the door opener according to the invention it is possible to compensate the increased door clearance by simply replacing the adapting element on the latch.

The detachable connection can in particular be constituted by a screw connection, but this also includes a clamping, plugging, bonding or any other suitable detachable connection. The detachable connection is chosen in such a way that the latch base is not damaged on releasing the adapting element. In the case of an adhesive connection the adhesive is chosen in such a way that its adhesive action cannot be removed by a solvent and/or by temperature action. According to a further advantageous development of the invention between the latch base and the adapting element there is a positive and non-positive connection. Such a connection, which can e.g. comprise a screw connection and a dovetail fit, is particularly reliable. This is especially necessary for a lockable and pivotable door latch, which is normally exposed to strong mechanical and thermal stresses for a long period of time.

In another further development of the door opener according to the invention shown in FIG. 4, several adapting elements 15*a*–15*c* are provided in the form of laminates, which have essentially an identical construction and a limited thickness. An adjustment or setting of the thickness of the adapting element can consequently be performed in very simple manner by adding a corresponding number of laminates with known thickness to the latch body. Therefore the thickness of the adapting element is a summation of the individual thicknesses of the laminates used.

For connecting the laminates to the latch base it is possible to use suitable positive and/or non-positive connections. The top laminate, which forms the locking surface of the latch, can differ from the other laminates as regards shape and material. In the case of a screw connection this top laminate can have a thickness making it possible to make a countersunk hole for countersinking the screw head. The other intermediate laminates are, in this embodiment, fixed by means of the screw connection between the top laminate and the latch base. In this case the thickness adaptation of the adapting element can be brought about by regulating the number of substantially identically constructed intermediate laminates.

In another embodiment of the invention one surface of the latch base, which is used for receiving the adapting element, is surface-parallel to the locking surface. In this case the adapting element can be formed in a constant layer thickness, which facilitates adapting work and leads to cost advantages in the manufacture of the adapting element. With an optimum pre-adjustment of the door opener in the door frame, the latch base can form the locking surface without the adapting element.

Advantageously, such that the adapting element essentially has the shape of a plate. Therefore the adapting element can be inexpensively worked from a plate material with the same thickness, e.g. cut from a sheet metal plate.

According to an advantageous embodiment of the invention, the adapting element is made from a particularly wear-proof material. The latter could be constituted by a hardened metal, a high-strength plastic, ceramic or some other suitable material. For forming the locking surface it is also possible to use wear-resistant materials which, due to their poor working characteristics and high costs, could not hitherto be used for a pivotable door latch. The latch base can still be made from an easily worked and shapable material, e.g. a cast metal. Consequently a high wear resistance, which also leads to low maintenance costs, is achieved with limited manufacturing costs.

According to an advantageous further development of the invention, the adapting element has a soundproofing material. The adapting element can be entirely made from the soundproofing material, have a soundproofing laminate or can be coated with a soundproofing coating. As a result of such a material, which can be a plastic or rubber material, there is a reduction in the amount of noise produced when the bolt strikes the locking surface of the latch. Such a soundproofing is more particularly desired in large apartment blocks with central door entrances.

BRIEF DESCRIPTION OF THE DRAWINGS

The invention is described in greater detail hereinafter relative to the drawings, wherein show.

DETAILED DESCRIPTION OF THE EMBODIMENTS

Figure 1:
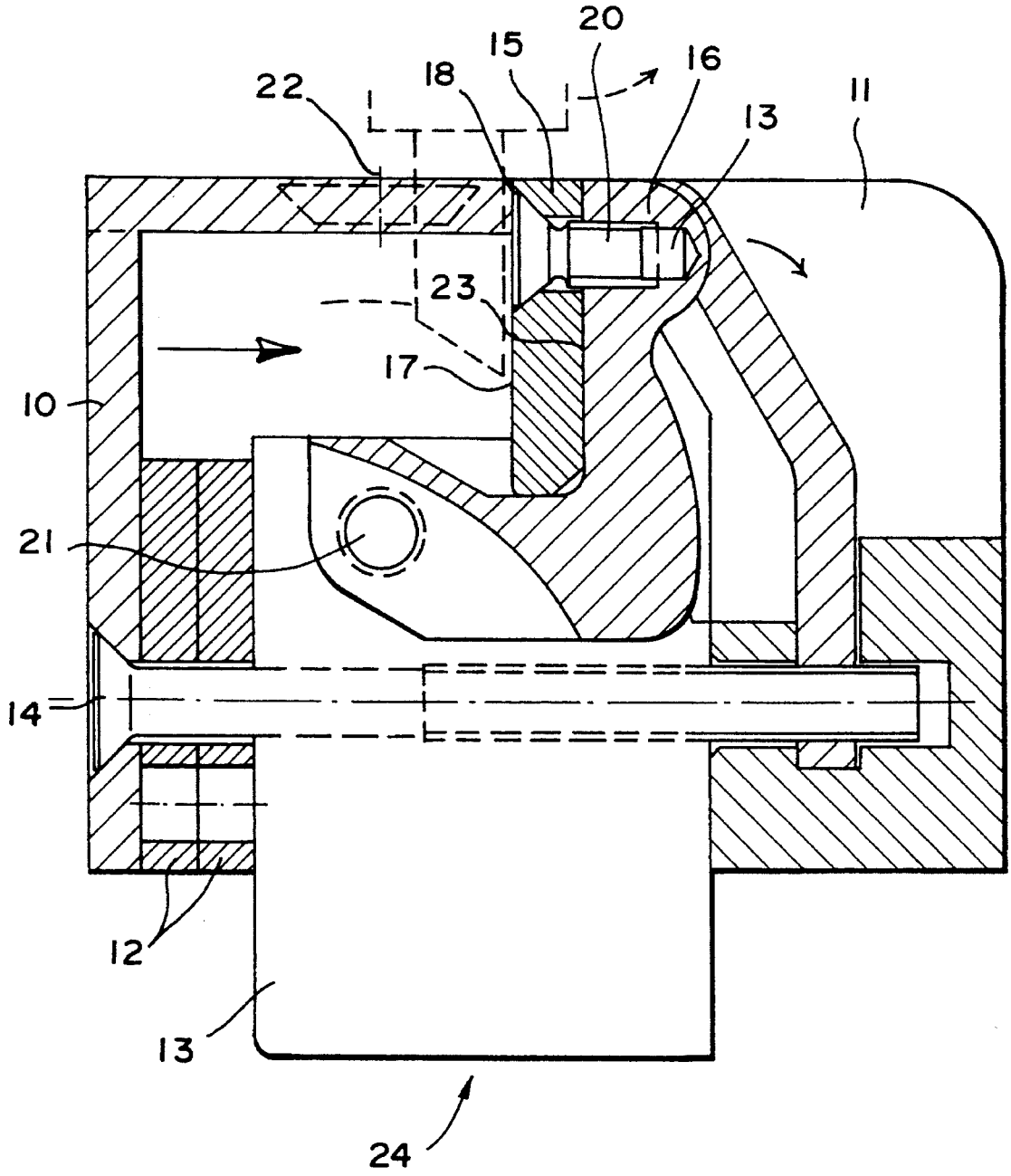
FIG. 1 A cross-sectional view through an embodiment of the door opener according to the invention.

FIG. 1 is a diagrammatic cross-sectional view of a door opener unit 24 according to the invention. The latter has a locking plate 10 for installation purposes. In this embodiment the locking plate 10 is constructed as a U-shaped, sheet metal face plate, on which are located all the further components of the door opener unit 24. A universal face plate 11 is inserted at a free leg of the sheet metal face plate. By means of a screw 14 a door opener insert 13 is fixed between the two free legs of the sheet metal face plate and the universal face plate 11. All the essential functional components of the door opener unit 24 are located in the door opener insert 13.

Figure 4:
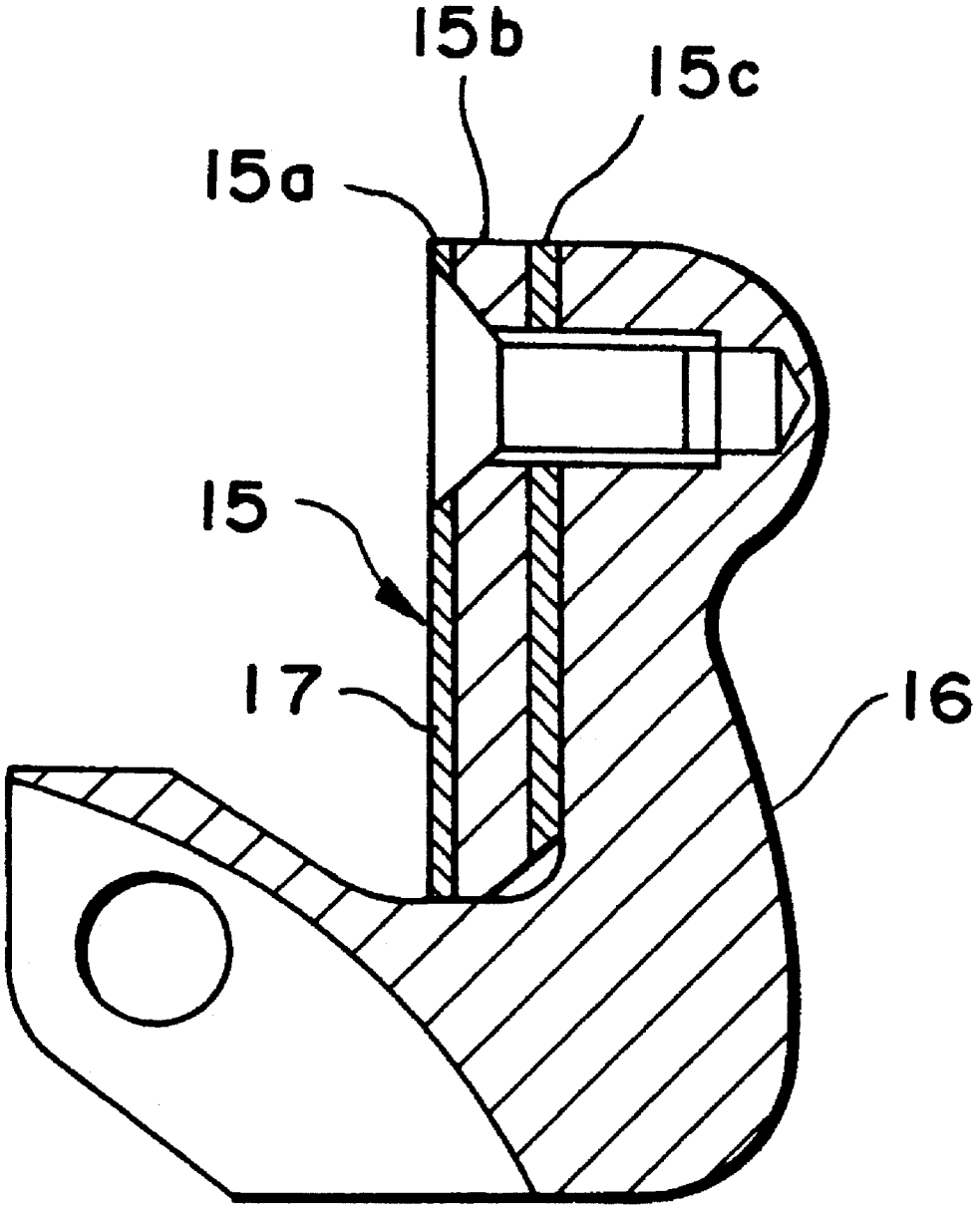
FIG. 4 An embodiment with a laminate construction formed of multiple adapting elements.

Only the pivotable and lockable latch is shown in the door opener unit 13 in order to facilitate easy understanding of the drawing. The locking and unlocking mechanism with an operating means and the electrical lines and connections of the latter are not shown since the construction of the door opener insert 13, by itself, forms no part of the present invention, nor do such other operating details and interrelationships beyond those described below. Thus, for example, the door opener insert 13 can be constructed in the manner of such known door openers as are described in European Patent Application 0 419 058 A1, French Patent Application Nos. FR-A 1 021 024 and FR-A 2 560 918, and German Patent Application DE-B I 028 193. Likewise, the present invention merely relates to an arrangement for adjusting the clearance between the locking surface of the pivotable latch and the locking bolt of the door, not the manner in which the pivotable latch interacts with the locking bolt of the door, which remains unchanged by the present invention, and for example, in the case of the above-mentioned door opener of European Patent Application 0 419 058 A1, the pivotable latch would engage the door bolt as shown in FIG. 4 thereof for its parts 12 and 15.

For the preadjustment of the door opener insert 13 with the pivotable latch in the U-shaped sheet metal face plate 10, two spacing plates 12 are inserted between the door opener insert 13 and a free leg of the face plate 10. In this embodiment with two spacing plates 12 there are in all three preadjustment positions of the door opener insert 13 in the face plate 10. In addition to the moved back position shown, there can also be a central and an advanced preadjustment position. In the central position in each case one spacing plate 12 is located at the left and at the right-hand side of the door opening insert 13. Correspondingly, in the advanced position the two spacing plates 12 are inserted at the right-hand side of the door opener insert 13 between the latter and the universal face plate 11.

The latch is pivotably mounted on a pivot pin 21 in the door opener insert 13. On said pivot pin 21 is positioned in rotary manner a leg of a cross-sectionally substantially L-shaped latch base 16. On the other leg of the latch base 16 there is a receiving surface 23, to which can be fitted an adapting element 15 for forming a locking surface 17. The receiving surface 23 of the latch base 16 is constructed as a planar surface, which is surface-parallel to the locking surface 17.

In this embodiment the adapting element 15 has a substantially plate-like configuration. The adapting element 15 is detachably connected to the latch base 16 by a cross-slotted screw 20 with a counterbore head. The latch base 16 has a tapped hole 19 for the screw connection. A through hole 18 in the adapting element 15 is countersunk corresponding to the head shape of the screw 20. The countersink is made in such a way that the screw head does not project over the locking surface 17 of the adapting element 15.

The door opener unit 24 is fixed by means of holes 22 in the locking plate 10 to the door frame. Prior to the installation of the door opener unit 24 the position of the bearing surface of a bolt of said door in the closed position is determined by measurement and calculation. The desired position of the locking surface 17 in the door opener unit 24 to be installed is determined from these values. This shows at which pre-adjustment position the door opener insert 13 must be adjusted in the door opener unit 24. Prior to the installation of the door opener unit 24 it is possible to fix an adapting element with the calculated necessary thickness to the receiving surface 23 of the latch base 16. After fitting the door opener unit 24 in the door frame, it is possible to establish with the door closed whether the door clearance diverges from a desired value. If this is the case, by simply replacing the adapting element 15 and with the door opener unit 24 still fitted, the correct door clearance can be set.

Figure 2:
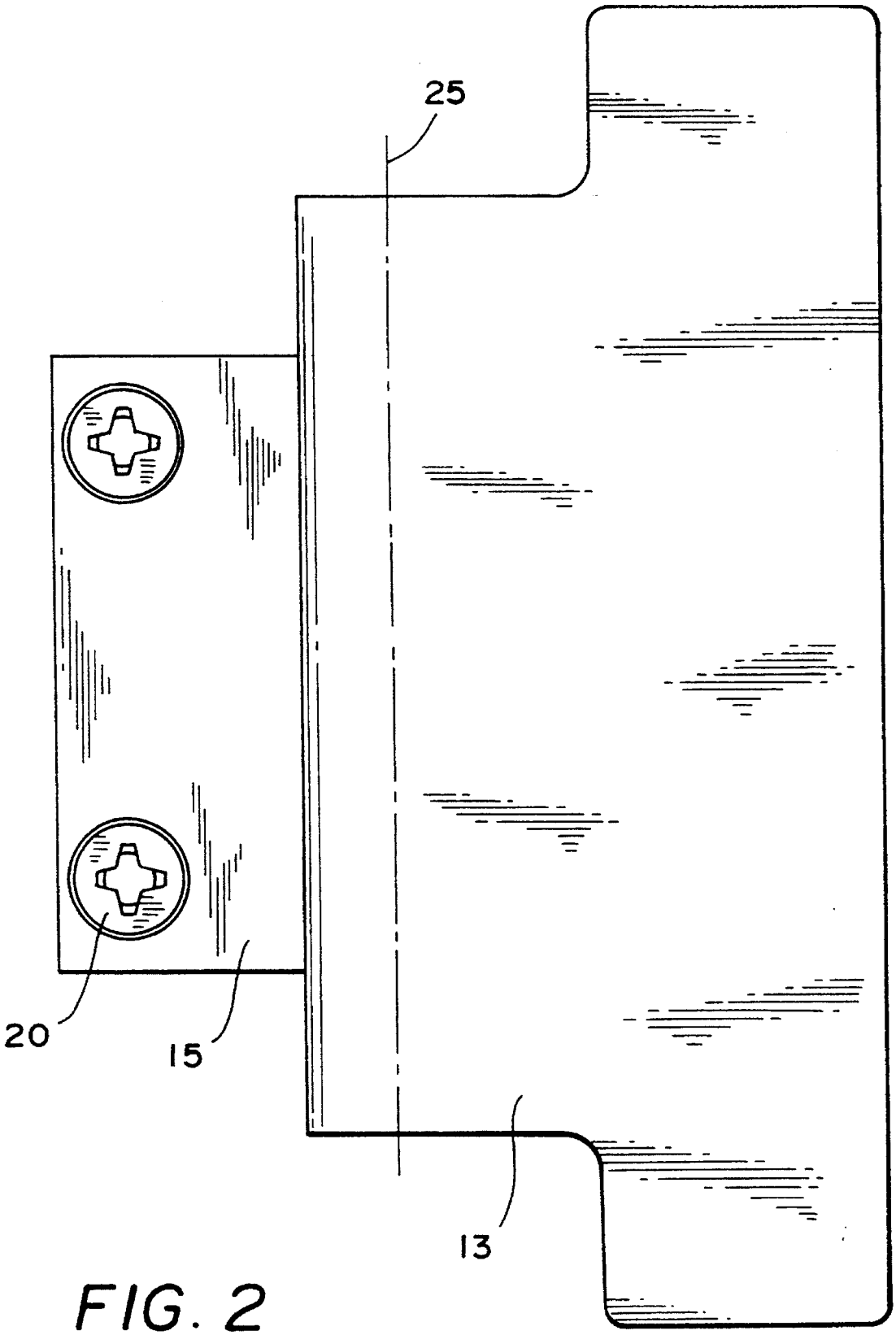
FIG. 2 A front view of a door opener insert with a pivotable latch by themselves as seen from the left as indicated by the arrow 2 of FIG. 1.

FIG. 2 shows part of the door opener unit 24 in front view in the viewing direction of FIG. 1. FIG. 2 essentially shows the door opener insert 13 and the adapting element 15 fixed to the latch. The dot-dash line 25 indicates the position of the pivot pin 21. FIG. 2 makes it clear that in this embodiment the adapting element 15 is detachably fitted by means of two cross-slotted screws to the latch base 16.

FIG. 3 shows several diagrammatic embodiments of the connection between the adapting element 15 and the latch base 16. The connection construction can be used individually or in combination with one or more of the other connection variants shown for fixing the adapting element 15 to the latch base 16. The connection formed shown in FIG. 3 can also be used in combination with a screw connection. As a function of the connection form and size and material of the adapting element, the screws used have different configurations, e.g. fillister, flat, socket or other appropriate head shapes.

Figure 3A:
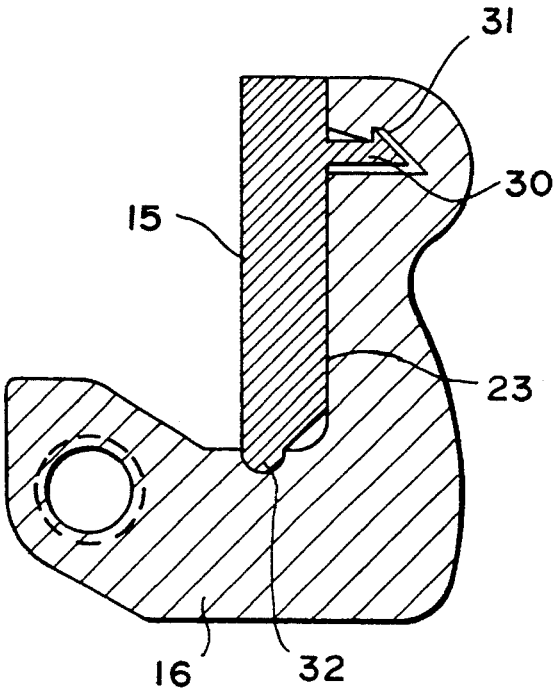
FIG. 3 Different embodiments of the connection between the adapting element and the latch base.

FIG. 3*a* shows a clip connection. On one side of the adapting element 15, which is in contact with the receiving surface 24 of the latch base 16, is formed a projection 30 with a sawtooth tip. The projection 30 engages in a key groove 31 formed in the receiving surface 23 of the latch base 16. In its end position the sawtooth-shaped key tip of the projection 30 engages in a recess of the key groove 31 in accordance with the principle of a barb, so that the adapting element 15 is firmly connected to the latch base 16. A cross-sectionally semicircular extension 32 on the adapting element 15 and which engages in a correspondingly shaped groove on the latch base 16, serves to facilitate the clipping process and for positionally fixing the adapting element 15 on the latch base 16.

Figure 3B:
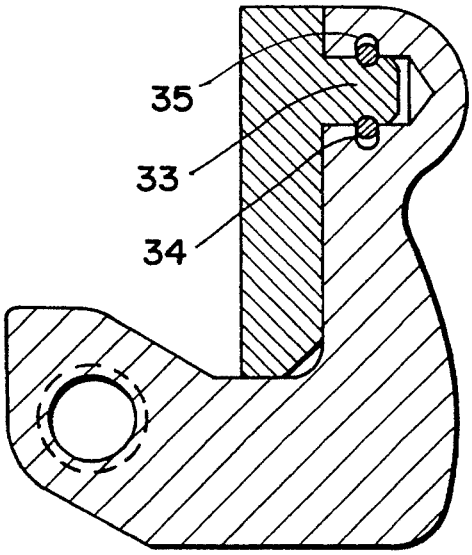

A similar, easily manufacturable connection form is shown in FIG. 3*b* and is in the form of a positive lock-on connection.

In the receiving surface 23 is formed a precision bore with a radial ring groove 35. Correspondingly on the opposite surface of the adapting element 15 there is a bolt-like projection 33 with a positively fitted, open wire ring 34. On inserting the bolt projection 33 in the bore of the latch base there is an elastic deformation of the wire ring 34. In the end position the wire ring 34 widens in the ring groove 35 and therefore positively links the adapting element 15 and the latch base 16. The two aforementioned connection variants are detachable to a limited extent. This means that although a detachment of the adapting element 15 is possible, the connection device on the adapting element is thereby destroyed. The material of the adapting element 15 is chosen in such a way that damage to the latch base 16 is substantially prevented. Thus, in the case of wear to the adapting element 15, the latter can be replaced.

Figure 3C:
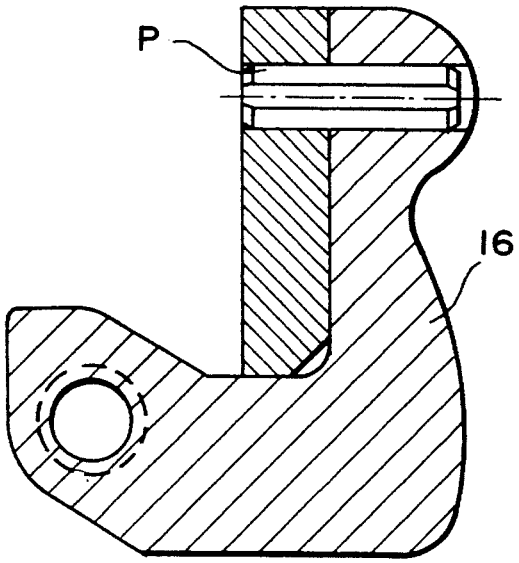
Figure 3D:
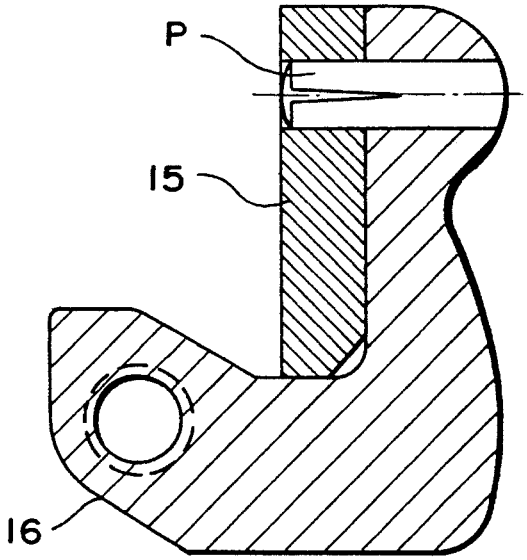

FIGS. 3*c* and 3*d* are non-positive connection types. The connection element is constituted by a clamp collar or slotted pin P.

FIGS. 3*e* to 3*h* show different groove fit shapes. The fits can be constructed as force or sliding fits. In the case of a sliding fit an additional fixing variant is necessary.

The dovetail, T-groove, L-groove and circular groove fits shown can be constructed in multiple or combined form on the adapting element. The longitudinal axis of the grooves can also be in another orientation, e.g. parallel to the sectional plane.

FIG. 3*i* shows an embodiment, in which the adapting element is bonded to the receiving surface of the latch base.

A riveted connection between the adapting element and the latch base is shown in FIG. 3*j*. In much the same way as with the screw connection shown in FIG. 1, the head of the rivet is located in a countersunk hole made in the adapting element. This ensures that the rivet head does not project over the locking surface.

By means of the present invention it is possible to manufacture in large numbers and in a few basic versions door opener units and to adapt same in optimum manner by the adapting element to the particular bolt shape. The fitting of the door opener unit in a door frame is also made simpler and faster through the possibility of a subsequent adjustment of the locking surface. Through the use of wear-resistant materials and the easy replaceability of the adapting element, the door opener according to the invention is particularly maintenance-friendly.

It is to be understood that although preferred embodiments of the invention have been described, various other embodiments and variations may occur to those skilled in the art. Any such other embodiments and variations which fall within the scope and spirit of the present invention are intended to be covered by the following claims.

What we claim is:

1. A door opener with a lockable, pivotable latch for installation in a door frame, said pivotable latch having a locking surface against which at least one bolt of a door engages in a closed position for fixing the position of the door in the door frame, and said pivotable latch being pivotable between a locked position and an unlocked position, the door being openable following pivoting of the latch into the unlocked position; wherein the latch has a latch base with a receiving surface and a plurality adapting elements, each of which is selectively and interchangeably connectable to the receiving surface of the latch base; wherein each adapting element is substantially plate-shaped, wherein one side of each adapting element rests on the receiving surface of the latch base and the opposite side of the adapting element is the locking surface and is parallel to said receiving surface; wherein the adapting elements has a respective predeterminable thickness, proper adjustment of the position of the locking surface relative to the at least one bolt of the door in the closed position being obtainable by selection and mounting of at least one of the adapting elements having an appropriate respective predetermined thickness.

2. A door opener according to claim 1, wherein the latch base and the at least one adapting element mounted thereon is housed in a door opener insert, the door opener insert being detachably connected to a locking plate for fixing the door opener in the door frame; and wherein at least one spacing plate having surfaces which are parallel to the locking surface and a predetermined thickness is provided between the door opener insert and the locking plate for presetting the position of the locking surface relative to the door frame.

3. A door opener according to claim 1, wherein the connection between the latch base and the adapting element is detachable.

4. A door opener according to claim 1, wherein several adapting elements are provided in the form of laminates.

5. A door opener according to claim 1, wherein the adapting element is made from a wear-resistant material.

6. A door opener according to claim 1, wherein the adapting element has a soundproofing material.

7. A door opener according to claim 1, wherein the adapting element is fixed to the latch base by a screw connection.

8. A door opener according to claim 1, wherein the adapting element is fixed by means of a clip to the latch base.

9. A door opener according to claim 1, wherein the adapting element is fixed by means of a groove connection with press fit to the latch base.

10. A door opener according to claim 1, wherein the adapting element is fixed by means of an interlocking connection to the latch base.

* * * * *